US007971717B2

(12) United States Patent
Eilert et al.

(10) Patent No.: US 7,971,717 B2
(45) Date of Patent: Jul. 5, 2011

(54) PACKAGING FOR HYGIENE PRODUCTS

(75) Inventors: Diana Eilert, Mannheim (DE); Kristin Olsson, Ladenburg (DE)

(73) Assignee: SCA Hygiene Products GmbH, Mannheim (DE)

( * ) Notice: Subject to any disclaimer, the term of this patent is extended or adjusted under 35 U.S.C. 154(b) by 14 days.

(21) Appl. No.: 12/524,073

(22) PCT Filed: Feb. 5, 2008

(86) PCT No.: PCT/EP2008/051384

§ 371 (c)(1),
(2), (4) Date: Jul. 22, 2009

(87) PCT Pub. No.: WO2008/104444

PCT Pub. Date: Sep. 4, 2008

(65) Prior Publication Data

US 2010/0084295 A1 Apr. 8, 2010

(30) Foreign Application Priority Data

Feb. 28, 2007 (DE) ..... 20 2007 002 960 U

(51) Int. Cl.
*B65D 85/672* (2006.01)

(52) U.S. Cl. ..... 206/391; 206/494; 206/410; 383/209; 383/906

(58) Field of Classification Search ..... 206/391, 206/494, 233, 410, 394; 383/203, 205, 207, 383/906, 209; 229/87.05
See application file for complete search history.

(56) References Cited

U.S. PATENT DOCUMENTS

| | | | | |
|---|---|---|---|---|
| 2,394,335 | A * | 2/1946 | Shapiro | 383/9 |
| 2,620,944 | A * | 12/1952 | Stahl | 222/107 |
| 3,339,820 | A * | 9/1967 | Krzyzanowski | 229/216 |
| 3,397,835 | A * | 8/1968 | Henning | 383/208 |
| 4,966,286 | A | 10/1990 | Muckenfuhs | |
| 5,054,619 | A * | 10/1991 | Muckenfuhs | 206/494 |
| 5,219,229 | A * | 6/1993 | Sengewald | 383/207 |
| 5,282,687 | A * | 2/1994 | Yee | 383/25 |
| 5,338,117 | A * | 8/1994 | Kucksdorf et al. | 383/9 |
| 5,462,166 | A * | 10/1995 | Minton et al. | 206/440 |
| 5,482,376 | A * | 1/1996 | Moseley et al. | 383/209 |
| 5,524,759 | A * | 6/1996 | Herzberg et al. | 206/494 |
| 5,593,229 | A * | 1/1997 | Warr | 383/209 |
| 5,611,626 | A * | 3/1997 | Warr | 383/10 |

(Continued)

FOREIGN PATENT DOCUMENTS

EP 0454541 10/1991

(Continued)

OTHER PUBLICATIONS

International Search Report dated Apr. 21, 2008 in PCT application.

*Primary Examiner* — David T Fidei
(74) *Attorney, Agent, or Firm* — Young & Thompson

(57) ABSTRACT

A packaging for hygiene products, includes, in order to define a volume accommodating the hygdene products, at least two main walls which are situated substantially opposite to one another and two side walls which connect the main walls with one another and that are situated substantially opposite to one another, a tear tab including at least one section of one of the main wails and one section of one of the side wails, the tear tab exposing a removal opening for removing hygiene products

20 Claims, 6 Drawing Sheets

U.S. PATENT DOCUMENTS

| | | | | |
|---|---|---|---|---|
| 5,655,843 | A | 8/1997 | Conrad | |
| 6,309,105 | B1 * | 10/2001 | Palumbo | 383/211 |
| 6,352,365 | B1 * | 3/2002 | Healy et al. | 383/209 |
| 6,402,379 | B1 * | 6/2002 | Albright | 383/209 |
| 6,698,928 | B2 * | 3/2004 | Miller | 383/205 |

FOREIGN PATENT DOCUMENTS

| | | | |
|---|---|---|---|
| JP | 11091797 | | 4/1999 |
| JP | 2004359322 | | 12/2004 |
| JP | 2006290383 | | 10/2006 |
| WO | WO 9011946 | A1 * | 10/1990 |

* cited by examiner

PACKAGING FOR HYGIENE PRODUCTS

BACKGROUND OF THE INVENTION

1. Field of the Invention

The present invention relates to packagings for hygiene products, in particular packagings for packing uncompressed rolls of toilet paper.

2. Description of the Related Art

It is known to pack hygiene products in packagings and to supply an appropriate number of packed hygiene products to end consumers. For example, rolls of toilet paper are often supplied to the end consumer in packs of 1×2, 2×2, 2×4, 3×3 or 4×3 rolls. The rolls of toilet paper are thereby normally arranged in the packaging in such a manner that the respective front ends of the rolls of toilet paper face outwards such that the winding axes of the toilet paper rolls are aligned substantially in parallel to one another. Such packs are also known in the field of other hygiene products that are wound onto rolls, in particular in the field of kitchen towels and household towels. The packagings of such packs are normally made of a plastic film material, in particular a substantially transparent plastic film material which is normally printed with product designations, trade names, trademark designations, decorations or the like.

The removal of the hygiene products, in particular the removal of the rolls of toilet paper or household or kitchen towels, from the packaging is then normally carried out by tearing open the packaging. The consumer normally only uses his hands to do so and pierces the film material with his fingers at a random point of the packaging, in particular in the region of the gaps between the hygiene products or in the region of the winding rolls, tears it open and removes the desired number of hygiene products. Left behind is a packaging that has been untidily torn open at a random point and in which the rolls of toilet paper are lying around in an untidy manner. In many cases, the packaging is also torn in the region of lettering or printing, and thus any product information possibly provided is no longer readable.

Known from WO 2006/022869 A1 is a flexible package for packing compressed hygiene products, which comprises a measure for the simple opening thereof. To open, a gusset provided in a side wall is torn open along a line of weakness such that an opening for removing the compressed hygiene products disposed in the flexible package is exposed in the side wall.

Known from U.S. Pat. No. 5,219,229 is a flexible packing used for accommodating compressible hygiene products. An opening that can be torn open along a line of weakness is provided such that an opening is exposed in the region of the top side and a side wall of the packaging for the removal of the compressed hygiene products.

The packagings cited in the two aforementioned prior art publications are only intended for use with compressed hygiene products, in particular compressed nappies or sanitary towels. The removal of the hygiene products from these packagings proves to be difficult once compression of the hygiene articles decreases as a result of already removed hygiene articles since the hygiene products are exposed either on just one side (WO 2006/022869 A1) or on two sides (U.S. Pat. No. 5,219,229) of the respective hygiene products, which makes it difficult to grip the hygiene products that are then no longer necessarily in the region of the respective openings.

SUMMARY OF THE INVENTION

Taking the aforementioned known prior art as a starting point, the object of the present invention is to provide a packaging for hygiene products that enables simple removal of the hygiene products from the packaging, in particular also in a uncompressed state of the hygiene products.

In order to define a volume accommodating the hygiene products, the packaging for hygiene products accordingly comprises at least two main walls substantially opposite one another and two side walls that connect the main walls with one another and that are situated substantially opposite to one another. According to the invention, a tear tab is provided, which includes at least one section of one of the main walls and one section of one of the side walls, the tear tab exposing a removal opening for the removal of hygiene products.

In the present disclosure, a tear tab is understood to mean a tab that can be torn open on at least one of its sides. It is also to be understood to mean a tab which remains fixedly attached to the rest of the packaging on at least one of its sides, i.e. is not completely separated from the packaging. Sections that are moved relative to the rest of the packaging owing to the tearing open of the tab are also understood to be part of the tear tab, in particular also sections that are fixedly attached to the rest of the packaging are understood to be part of the tear tab. However, the tear tab can also be configured as a separate part.

Owing to the provision of a tear tab that at least includes sections in one main wall and in one side wall, a removal opening is provided which exposes, at least partially, at least two sides of the hygiene product, which are typically at a right angle to one another. Owing to the particular shape of the removal opening, the hygiene product is easy to grip, in particular also in an uncompressed state of the hygiene products, since it is possible to reach into the packaging and grip at least two sides of the hygiene product at the same time. Furthermore, removal from the packaging can take place at a defined position, so that an untidy tearing open of the packaging at a random point of the packaging is avoided and the hygiene products can be removed from the packaging one after the other in an orderly manner. In particular, the hygiene products remaining in the packaging thereby substantially remain in the originally intended order, and thus the packaging with the remaining hygiene products can be stored simply and tidily and the hygiene products cannot inadvertently fall out.

In a preferred embodiment, the tear tab comprises a section of each of the two main walls and a section of a side wall. A removal opening is exposed by means hereof, as a result of which the hygiene products are exposed on at least three sides. Normally the three sides are substantially perpendicular to one another. In the case of, for example, a roll of toilet paper, this roll can be easily gripped by a user at the two front ends (for example via the opening of the winding tube), which are typically orientated in the direction of the main walls, and removed from the packaging.

Owing to the provision of the tear tab such that it is disposed at least in one side wall and one main wall, i.e. such that it includes sections that are typically situated substantially perpendicular to one another, it is furthermore rendered possible for the tear tab to return at least to a certain extent to the closed position owing to the elasticity of the material. It can also be ensured in this manner that the hygiene products remain in an orderly state in the packaging, even once a certain number of hygiene products have already been removed from the packaging. This is not the case, for example, with a tear tab that is only found in a single plane of the packaging. Such a tear tab that is found in only one plane of the packaging will always hang downwards in the direction of gravity, following the opening process.

In a preferred variant, the tear tab is disposed in the region of a corner, in particular a top corner, of the packaging. It can be achieved in this manner that the hygiene products remaining in the packaging following removal of a hygiene product from the packaging do not fall out of the packaging, and that the removal opening in the provided position of the packaging is always above the hygiene products remaining in the packaging.

In a preferred variant, the tear tab is attached to the packaging at least in the region of the side wall. It is hereby achieved that the tear tab is not completely torn off of the packaging during opening, but rather always remains attached to the packaging so that closure of the removal opening is possible.

In order to enable the packaging to be resealed following removal of a hygiene product, the tear tab is preferably provided with a means for resealing, in particular a resealable adhesive strip.

At least one of the side walls and/or one of the main walls can be curved, in particular arc-shaped or rounded. Such a design of the respective walls enables the accommodation in an advantageous manner of hygiene products wound onto a roll. It is thereby in particular possible to arrange the hygiene products in the form of rolls in the packaging such that the respective front ends of a column of rolls abut one another, i.e. the respective axes of the rolls are substantially in a line.

At least one line of weakness is formed in the material of the packaging in order to form the tear tab, said line of weakness extending in the main wall. It is hereby possible to form, in particular, a tear tab in which at least one section extends in one of the main walls and one section extends in one of the side walls.

However, the tear tab is preferably formed by two lines of weakness, with one line of weakness extending in the one main wall and the other line of weakness extending in the other main wall. The two lines of weakness preferably meet in at least one region of the packaging, preferably in the upper region of the packaging or in the region of an overlap of the two main walls. In this design of the packaging, it is possible to realise, owing to the provision of the two lines of weakness that extend in the main walls, a tear tab that provides a removal opening which extends over the two main walls and one side wall. This ensures the simple removal of the hygiene products through the resulting removal opening, as already explained above.

The line of weakness preferably extends substantially parallel to the plane of the side wall. This enables, on the one hand, a simple producibility of the line of weakness since it extends, in a packaging machine, in the machine direction, and on the other hand provides an intuitively operable tear tab, which can be simply torn open towards the outside of the packaging.

In a further preferred embodiment, the line of weakness is curved and in particular arc-shaped so that it extends in an arc, for example, from a top side of the packaging up to a side wall of the packaging. A simple opening of the packaging can be achieved in this manner.

In a preferred embodiment of the packaging, the tear tab is defined in the main wall by the line of weakness and by a region that is fixedly attached to the main wall. The line of weakness and the region of the tear tab fixedly attached to the main wall are preferably perpendicular to one another. It is again possible in this manner to provide a tear tab which, owing to the elasticity of the material, tends to return to the closed position.

The line of weakness is preferably formed by perforation of the wall material of the packaging. The provision of a perforation constitutes a conventional and easy to use method for generating a line of weakness.

In a preferred variant, the tear tab comprises a grip section for gripping the tear tab. At least one opening through which fingers can be placed is advantageously provided in the grip section. Owing to this design of the tear tab, it is immediately intuitively clear where and how the packaging for hygiene products can be opened. The provision of a hole for the insertion of fingers is in particular also advantageous in that disabled or older persons are also easily able to grip and open the packaging without requiring a lot of effort.

In a further variant of the packaging, the packaging comprises at least a top side and a bottom side substantially opposite thereto, and the tear tab is located in the region of the top side. Furthermore, a removal opening is formed hereby, which at least partially exposes the hygiene product on at least three, in particular also on four sides, namely the top side, the two main walls and a side wall of the packaging, so that the hygiene product can be easily removed from the packaging.

A handle for carrying the packaging is preferably provided on the top side of the packaging, and the tear tab includes a section of the handle. The handle also preferably comprises a grip section for gripping the tear tab. The hygiene product can be easily and intuitively opened owing to the provision on the one hand of a handle for carrying and on the other hand of a grip section for gripping the tear tab.

It is preferred that the tear tab is provided such that it exposes a removal opening in such a manner that a hygiene product is at least partially exposed on at least three sides for removal. However, preferably the hygiene product is at least partially exposed on four sides in order to enable simple removal from the packaging.

The packaging preferably accommodates at least two uncompressed hygiene products, in particular two uncompressed hygiene products wound onto rolls, in particular toilet paper rolls, kitchen paper rolls or household paper rolls. The walls of the packaging are preferably made of a film material, in particular of a substantially transparent film material.

BRIEF DESCRIPTION OF THE DRAWING FIGURES

The invention will be described in more detail below with reference to the drawings, in which.

DETAILED DESCRIPTION OF THE INVENTION

In the following description of the respective embodiments, the same reference numbers are used for the same or similar features and the respective features will not be described again.

Figure 1:
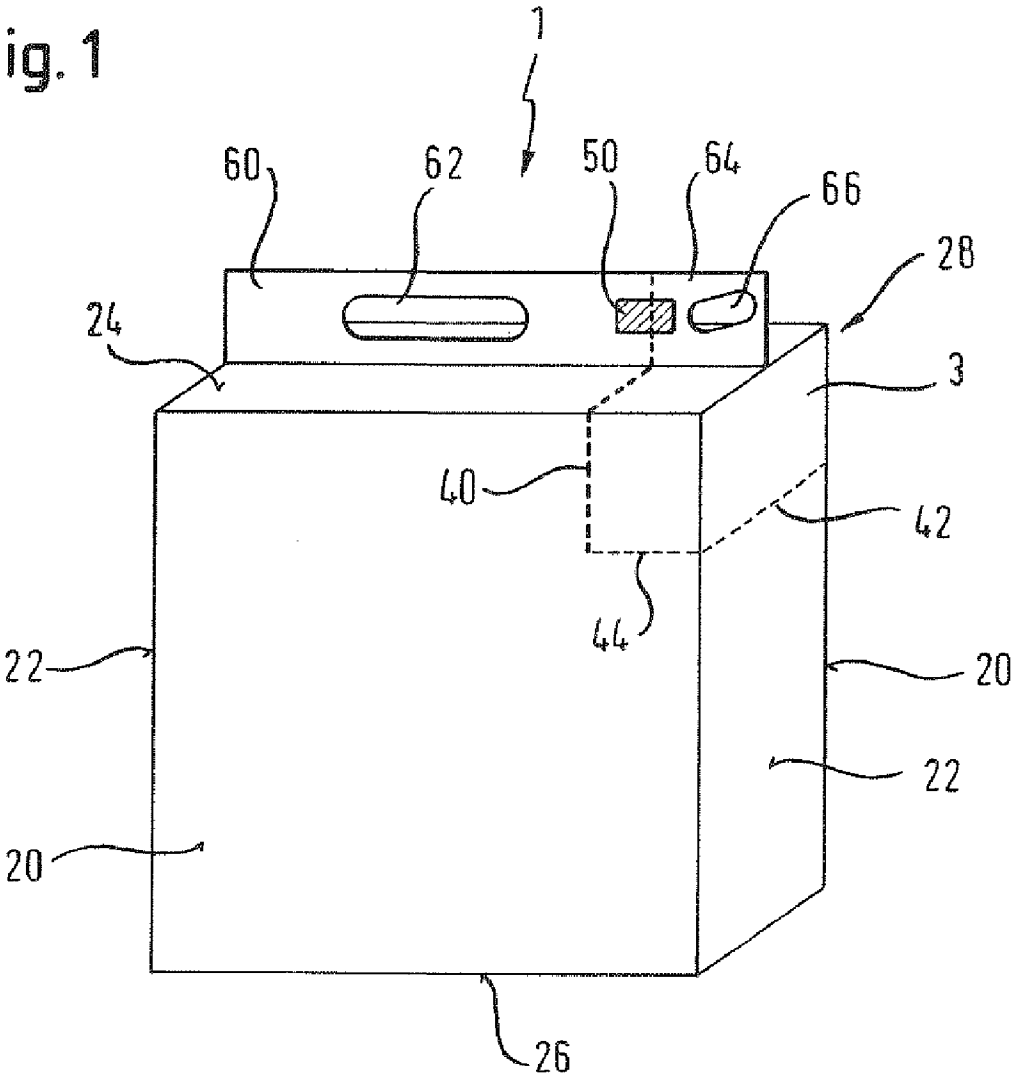
FIG. 1 shows a schematic perspective view of a packaging according to a first embodiment of the invention.

FIG. 1 shows a schematic perspective view of a packaging 1 for hygiene products. The packaging has two main walls 20 that are situated substantially opposite to one another, two side walls 22 that connect the main walls with one another and which are situated substantially opposite to one another, as well as a top side 24 and a bottom side 26.

Furthermore, the packaging comprises a handle 62 on the top side 24, which is positioned in a material region protruding from the top side 24. The protruding material region is typically provided by an overlap 60 and gluing or welding the two main walls 20 together in order to close the packaging 1.

The packaging 1 is substantially made of a film material that is preferably transparent and is welded or glued together at least in both, the region of the overlap 60 and on the bottom side 26 such that the film material surrounds the hygiene products accommodated in the volume defined by the packaging.

A tear tab 3 is provided in a top corner 28 of the packaging and serves to expose a removal opening for the removal of hygiene products from the packaging. The tear tab 3 is defined by a line of weakness 40 that extends substantially perpendicularly in the main wall 20 and that, in the embodiment shown in FIG. 1, also extends over the top side 24 of the packaging 1 and the overlap 60. The film material of the packaging can be ripped in the region of the line of weakness 40 such that the removal opening is exposed. The line of weakness 40, thus, extends substantially in parallel to the plane defined by the side wall 22.

Furthermore, the tear tab 3 is defined by a region 44 that also extends in the main wall 20, however substantially perpendicular to the line of weakness 40. Depending on the design of the tear tab, the region 44 can be either also designed as a line of weakness or can represent a fixed attachment of the tear tab to the rest of the film material of the main wall 20. If the region 44 is fixed to the rest of the packaging, this region is rather to be understood as a "virtual" line, which delimits the section forming the tear tab 3 from the rest of the packaging.

Furthermore, a region 42 is provided in the side wall 22 which can also be provided either as a line of weakness or as a fixedly attached region. It is also the case here that if the region 42 is fixedly attached to the rest of the packaging, this region is rather supposed to be understood as a "virtual" line that delimits the tear tab 3 from the rest of the packaging.

If both, the region 44 provided in the main wall and the region 42 provided in the side wall 22 are each fixedly attached to the rest of the material of the packaging, i.e. if there is no line of weakness along the regions 42 and 44, it is nevertheless still possible to tear open the tear tab 3 in relation to the rest of the packaging in a manner such as is shown below in, for example, FIGS. 4 and 5.

In order to simplify the tearing open of the tear tab 3, a grip section 64 is provided in the upper region of the tear tab 3, which is furthermore provided with an opening 66 through which fingers can be placed. By gripping into the opening 66 and pulling in the direction of the outside of the packaging 1, in particular in a direction parallel to the plane of the main walls 20, it is possible in a simple manner to open the packaging and expose a removal opening for the removal of hygiene products in the region of the then torn open tear tab 3.

The removal opening can be resealed by folding back the tear tab 3, with it being possible for said tear tab 3 to be reattached to the rest of the packaging material for example by means of an adhesive strip 50.

Figure 2:
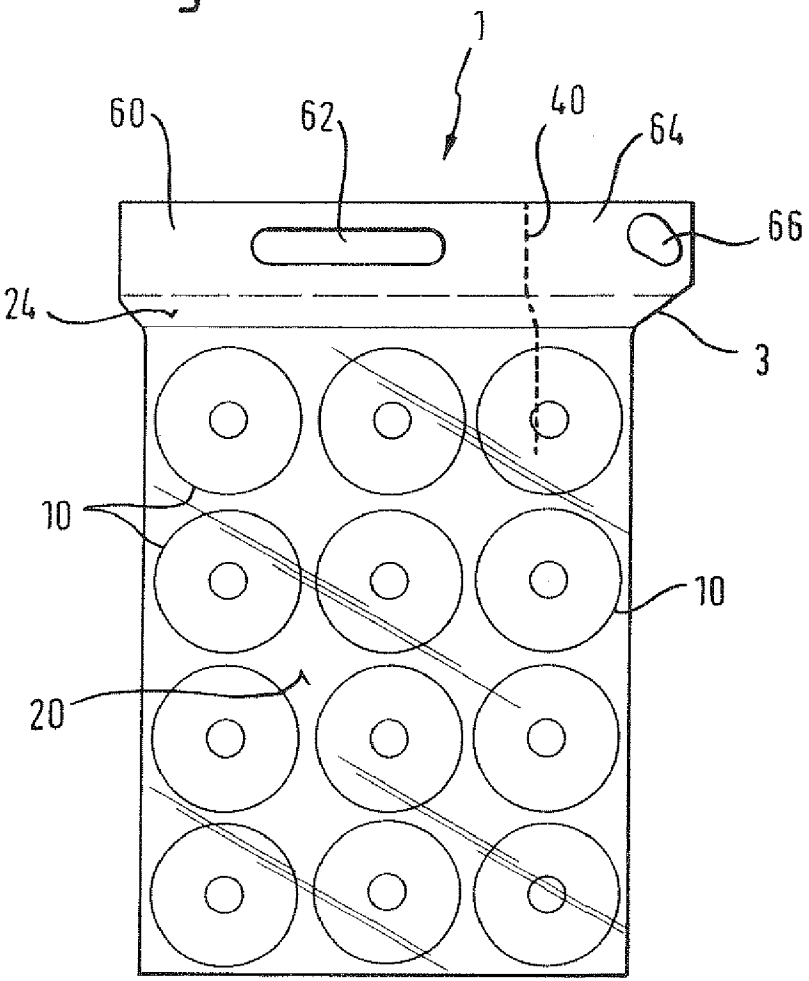
FIG. 2 shows a schematic side view of a packaging according to the present disclosure in a second embodiment.

In particular in the case where the regions 44 and 42 are not configured as lines of weakness and accordingly do not tear as intended when the packaging is opened, the elasticity or rigidity of the material of the packaging can also cause the tear tab 3 to substantially return to the closed position. Shown in FIG. 2 is a second packaging 1 according to the present disclosure. The packaging is supposed to be understood here as being made of a transparent material, such that the hygiene products disposed in the packaging 1 in the form of a collection of 4×3 toilet paper rolls 10 are clearly visible. The hygiene products 10 can, however, be present in the form of any hygiene products wound onto rolls, in particular also in the form of household paper rolls or kitchen paper rolls.

The toilet paper rolls 10 in the arrangement shown in FIG. 2 are stacked in the packaging 1 such that the axes of the respective rolls are substantially parallel to one another and are substantially perpendicular to the plane defined by the main wall.

In the embodiment shown in FIGS. 2 to 5, the transparent front wall 20, the top wall 24 as well as the overlap region 60 with the handle 62 can be recognised. The tear tab 3 with the grip section 64 and the opening 66 made therein can also be recognised. A line of weakness 40 in the form of a perforation 40 that extends substantially perpendicularly is also visible.

Figure 3:
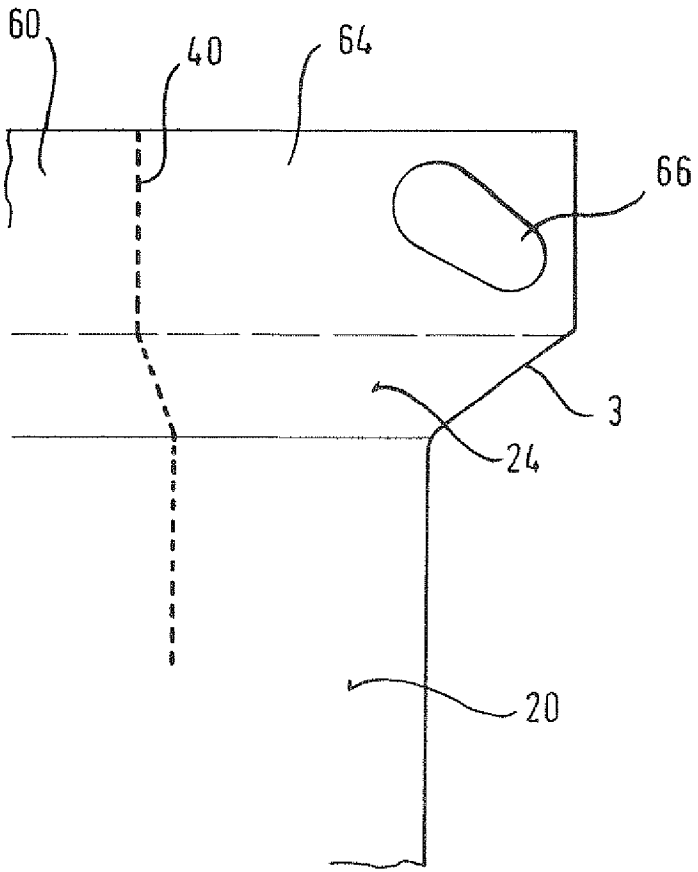
FIG. 3 shows an enlargement of a section of the schematic side view of FIG. 2.

The region of the tear tab 3 is shown again in FIG. 3 in an enlarged view. Both, the perforation 40 and the grip section 64 with the opening 66 are clearly recognisable herein.

Figure 5:
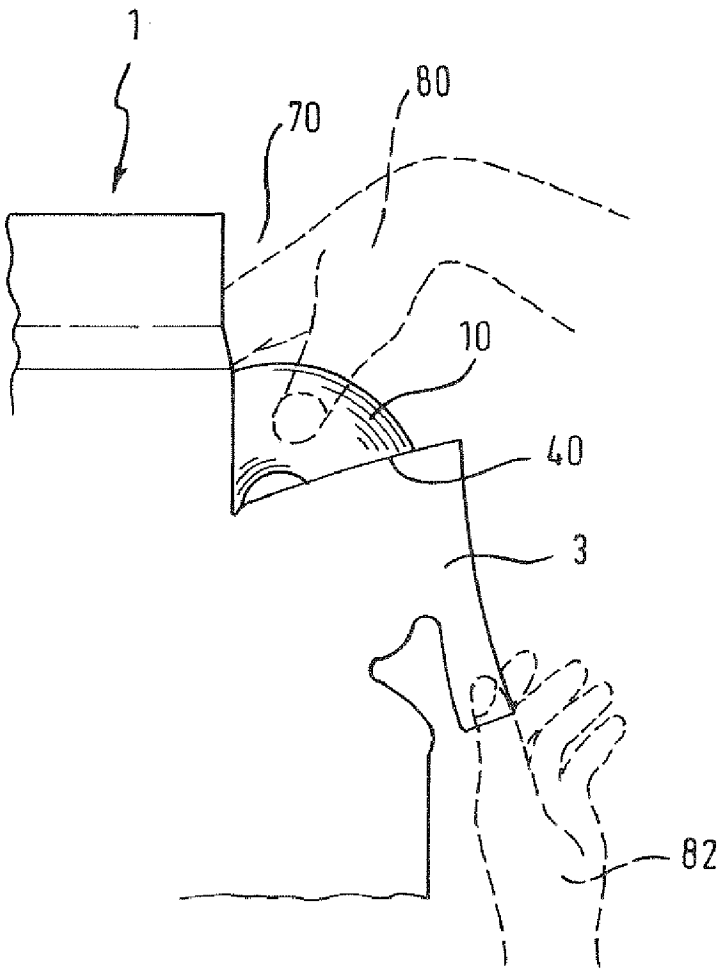
FIG. 5 shows a schematic, enlarged representation of the removal opening of the packaging according to FIG. 4 in a removal position.
Figure 4:
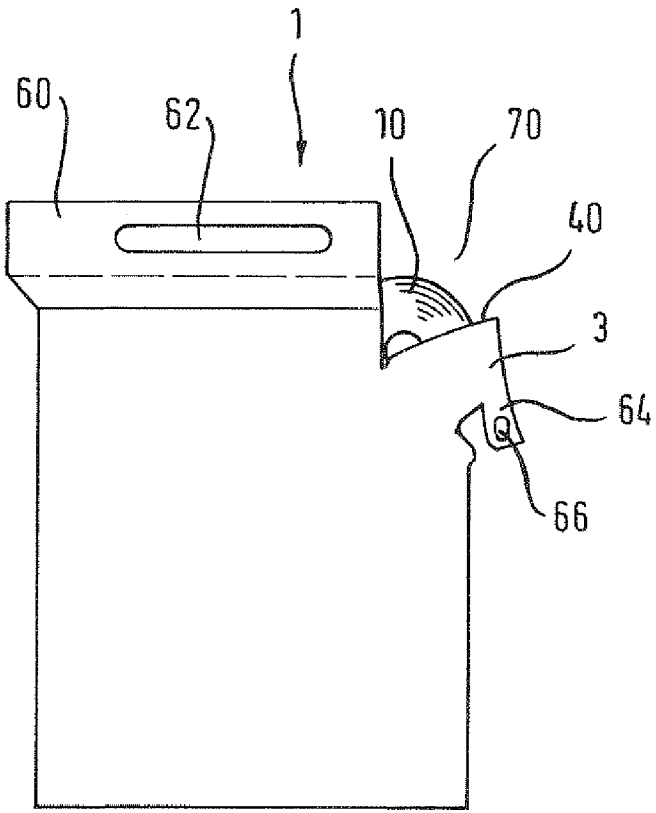
FIG. 4 shows a schematic representation of the packaging according to FIGS. 2 and 3 in an open state.

FIGS. 4 and 5 show the packaging according to FIGS. 2 and 3 in an open state. In particular, the tear tab 3 has been opened along the perforation 40 by pulling the grip section 64 in such a manner that a removal opening 70 for removing the hygiene products 10 is exposed. As can be clearly recognised in FIG. 4, the hygiene product 10 is at least partially exposed by the removal opening 70 both, on the two front ends of the toilet paper roll as well as on the top side thereof and along the right side. As is schematically shown in FIG. 5, for example, a user can accordingly remove the toilet paper roll 10 from the packaging 1 by simply gripping it with his hand 80. Meanwhile, the other hand 82 holds open the removal opening 70 by pulling the tear tab 3 in a direction in which the removal opening 70 is kept open. The removal opening 70 is thereby opened along the perforation 40.

As can be seen in particular from FIGS. 4 and 5, the material of the packaging 1 is deformed in the region of the tear tab 3, in particular in the regions 42 and 44, such that if a suitable foil material is used, the tear tab 3 substantially returns to its starting position once it is released. An almost automatic resealing of the packaging can be achieved in this manner.

Figure 7:
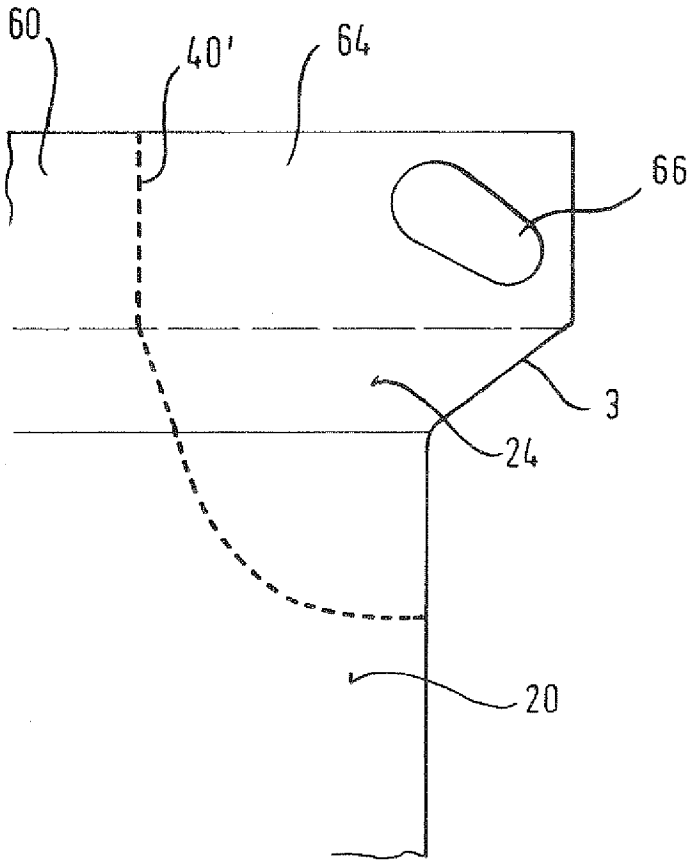
FIG. 7 is an enlargement of a section of the packaging according to FIG. 6.
Figure 6:
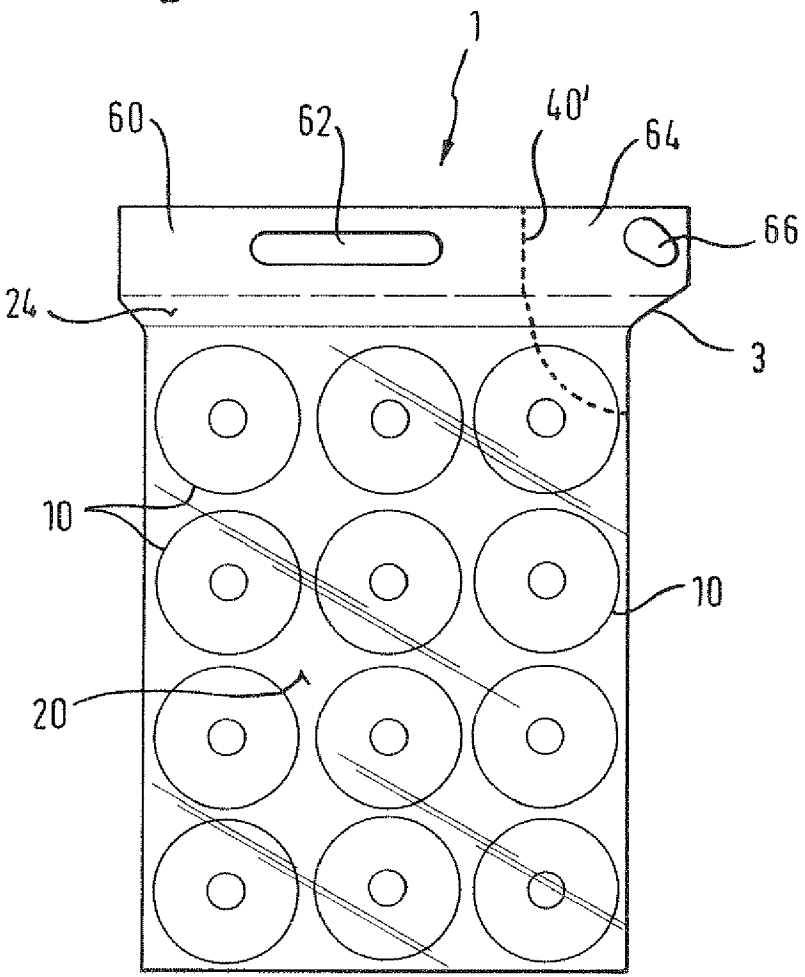
FIG. 6 is a schematic side view of a packaging according to the present disclosure in a third embodiment.

Shown in FIGS. 6 and 7 is a further embodiment of the packaging 1. In contrast to the packagings described above, the tear tab 3 in this case is defined by a substantially arc-shaped region of weakness 40'. The region of weakness 40' thereby extends from the region of the overlap 60, over the main wall 20 and up to the side wall 22.

Figure 8:
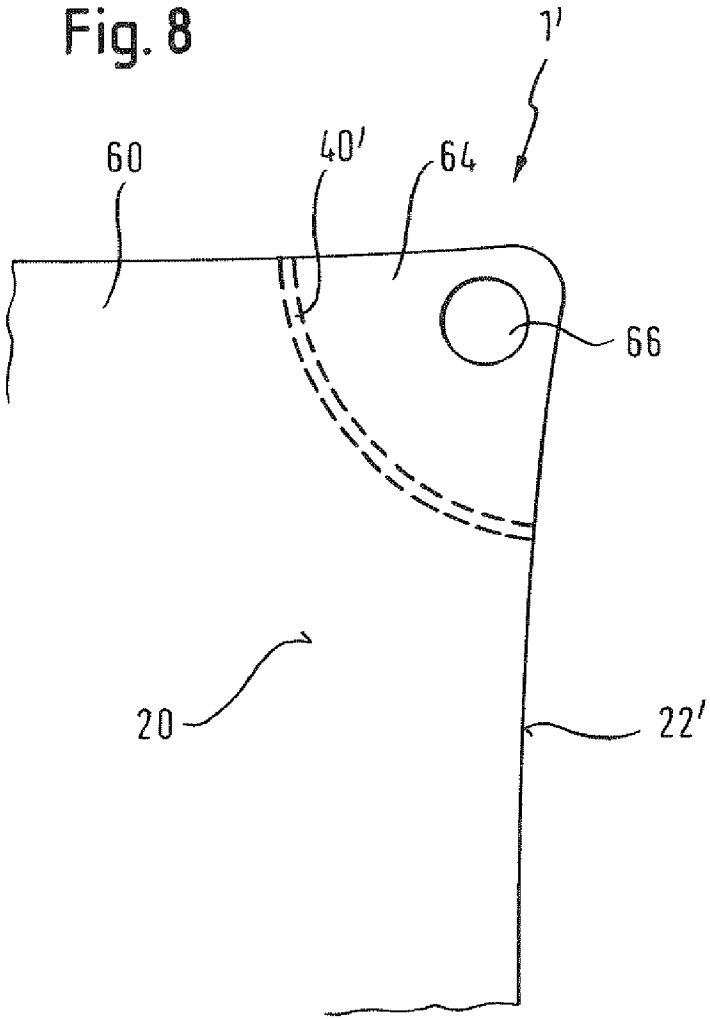
FIG. 8 is a schematic, enlarged side view of a region of a packaging around a tear tab in a fourth embodiment.
Figure 10:
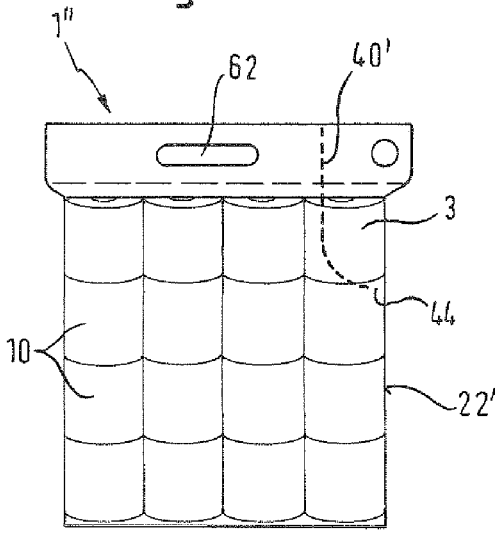
FIGS. 10 to 13 are schematic side views of a further embodiment according to the present disclosure in an overall view and an enlarged view, each in the closed and open state.
Figure 11:
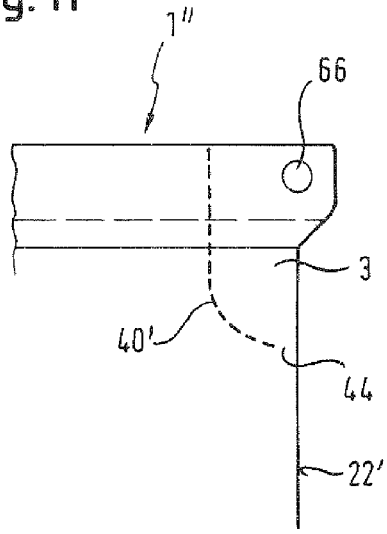

Another embodiment of a packaging 1' is shown in FIG. 8, in which at least the side wall 22' is substantially rounded. This rounding is provided to accommodate in the packaging 1' hygiene paper rolls that stand upright on their front ends in the packaging. Such an arrangement of the hygiene paper rolls is also provided, for example, in FIGS. 10 to 13 as described below.

In the embodiment shown in FIG. 8, the line of weakness is again arc-shaped and again extends from an overlap region 60 up to the rounded side wall 22'.

Figure 9:
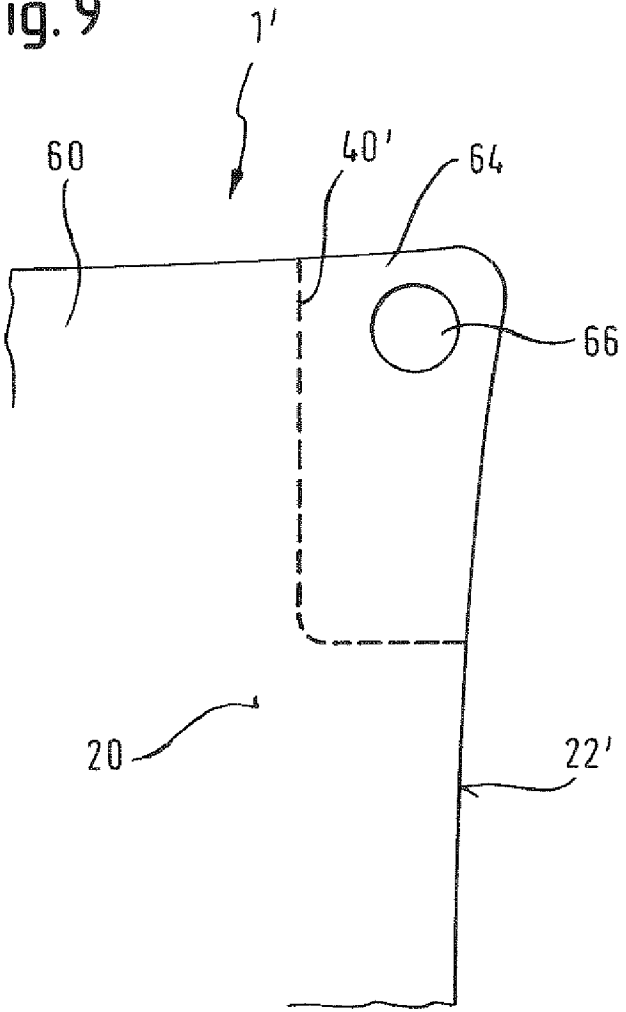
FIG. 9 is a schematic, enlarged side view of a region of a packaging around a tear tab in a fifth embodiment.

Shown in FIG. 9 is a packaging similar to that of FIG. 8, however the line of weakness 40' is shown in an angular design herein.

Shown in FIGS. 10 to 13 is a packaging 1" in a further embodiment. In this packaging 1", the hygiene products 10, which are shown as toilet paper rolls, are arranged in an orientation differing from that of FIG. 2. The toilet paper rolls 10, which are arranged in a 4×4 configuration, are in particular placed one on top of the other in each column. In particular, the axes of the respective rolls of the columns are thus aligned in parallel to the plane formed by the main walls 20 and are substantially in a line in each column.

Figure 12:
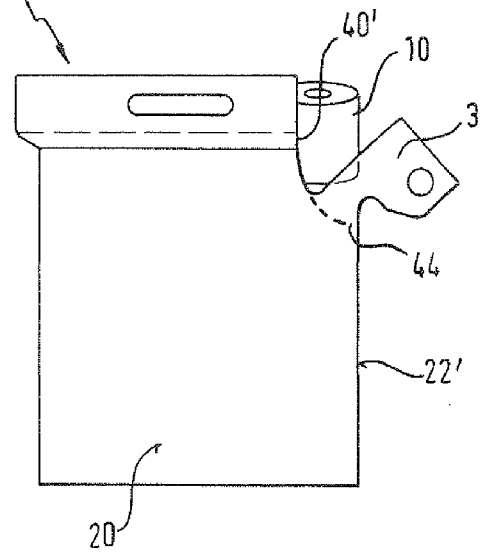
Figure 13:
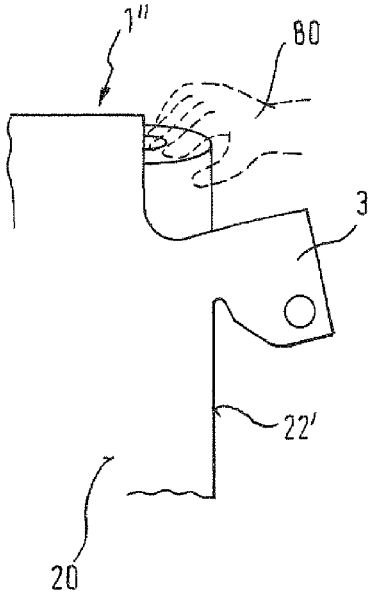

In this embodiment, the hygiene products 10, as can be seen particularly well in FIGS. 12 and 13, are exposed by tearing open the tear tab 3 such that the front ends of the toilet paper rolls 10 are facing upwards. The tear tab 3 is herein again formed by a substantially curved line of weakness 40', which, in the shown embodiment, is not, however, continued right up to the rounded side wall 22', but is rather "virtually" extended already on the main wall 20 by a region 44 which is fixedly attached to the main wall 20.

In the packagings shown in FIGS. 1 to 13, the tear tabs 3 are each integrally integrated in the film material forming the packagings. This integral integration is achieved in that the tear tabs are moulded into the material by means of the corresponding lines of weakness or the corresponding punchings. In an embodiment of the packaging which is not shown, it is, however, also conceivable to provide the tear tabs as separate elements that are attached to the packaging in the region of the desired removal opening.

The invention claimed is:

1. A packaging for hygiene products, comprising:

at least two main walls which are situated substantially opposite to one another and two side walls which connect the main walls with one another and that are situated substantially opposite to one another, wherein on a top side of the packaging an overlap is provided by gluing or welding together the two main walls, the main walls and side walls defining a volume accommodating the hygiene products a handle being provided in the overlap;

a tear tab including a section of each of the two main walls and a section of a side wall, said tear tab exposing a removal opening for removing hygiene products, the tear tab being formed by two lines of weakness, one line of weakness extending in one main wall and the other line of weakness extending in the other main wall, the two lines of weakness meeting in the region of the overlap of the main walls, and extending in the main walls in an angular, curved, or arc-shaped, manner; and a grip section included in the tear tab, the grip section being configured for gripping said tear tab, the grip section comprising at least one opening through which fingers can be placed, wherein said packaging is configured to accommodate at least two uncompressed hygiene products wound onto rolls selected from the group consisting of toilet paper rolls, kitchen paper rolls and household paper rolls.

2. The packaging according to claim 1, wherein the tear tab comprises at least one means for resealing.

3. The packaging according to claim 1, wherein at least one of the side walls and/or of the main walls is curved.

4. The packaging according to claim 1, wherein the tear tab is defined in the main wall by the line of weakness and by a region fixedly attached to the main wall.

5. The packaging according to claim 1, wherein the line of weakness extends along the entire section of the tear tab defined in the main wall.

6. The packaging according to claim 1, wherein the line of weakness is formed by a perforation of the wall material.

7. The packaging according to claim 1, further comprising at least a top side and a bottom side substantially opposite thereto, and said tear tab including a section of the top side.

8. The packaging according to claim 7, further comprising a handle on the top side for carrying the packaging and said tear tab including a section of said handle.

9. The packaging according to claim 1, wherein the tear tab exposes a removal opening, which at least partially exposes a hygiene product for removal on at least three sides.

10. The packaging according to claim 9, wherein the removal opening at least partially exposes the hygiene product on four sides.

11. The packaging according to claim 1, wherein the tear tab is configured integrally with the rest of the packaging.

12. The packaging according to claim 1, wherein the tear tab is configured as a separate element.

13. The packaging according to claim 1, wherein the walls are made of a substantially transparent film material.

14. The packaging according to claim 2, wherein the means for resealing comprises a resealable adhesive strip.

15. The packaging according to claim 3, wherein at least one of the side walls and the main walls is rounded.

16. A package of hygiene products, comprising:

at least two main walls which are situated substantially opposite to one another and two side walls which connect the main walls with one another and that are situated substantially opposite to one another, wherein on a top side of the packaging an overlap is provided by gluing or welding together the two main walls, the main walls and side walls defining a volume accommodating the hygiene products a handle being provided in the overlap;

a tear tab including a section of each of the two main walls and a section of a side wall, said tear tab exposing a removal opening for removing hygiene products, the tear tab being formed by two lines of weakness, one line of weakness extending in one main wall and the other line of weakness extending in the other main wall, the two lines of weakness meeting in the region of the overlap of the main walls, and extending in the main walls in an angular, curved, or arc-shaped, manner;

a grip section included in the tear tab, the grip section being configured for gripping said tear tab, the grip section comprising at least one opening through which fingers can be placed; and at least two uncompressed hygiene products wound onto rolls selected from the group consisting of toilet paper rolls, kitchen paper rolls and household paper rolls, the hygiene products being insider the package.

17. The package according to claim 16, wherein the tear tab comprises at least one means for resealing.

18. The package according to claim 16, wherein at least one of the side walls and/or of the main walls is curved.

19. The package according to claim 16, wherein the tear tab is defined in the main wall by the line of weakness and by a region fixedly attached to the main wall.

20. The package according to claim 1, wherein the line of weakness extends along the entire section of the tear tab defined in the main wall.

* * * * *